US010262498B2

(12) United States Patent
Caughill et al.

(10) Patent No.: US 10,262,498 B2
(45) Date of Patent: Apr. 16, 2019

(54) SYSTEM AND METHOD OF GENERATING HYBRID LOTTERY TICKETS

(75) Inventors: Adam Bruce Caughill, Sault Ste. Marie (CA); Steven Joseph Dolan, Toronto (CA); Ji Huang, Markham (CA)

(73) Assignee: ONTARIO LOTTERY AND GAMING CORPORATION, Toronto (CA)

( * ) Notice: Subject to any disclaimer, the term of this patent is extended or adjusted under 35 U.S.C. 154(b) by 522 days.

(21) Appl. No.: 13/493,038

(22) Filed: Jun. 11, 2012

(65) Prior Publication Data

US 2013/0029743 A1 Jan. 31, 2013

Related U.S. Application Data

(60) Provisional application No. 61/511,656, filed on Jul. 26, 2011.

(51) Int. Cl.
*G07F 17/32* (2006.01)

(52) U.S. Cl.
CPC ..... *G07F 17/326* (2013.01); *G07F 17/329* (2013.01)

(58) Field of Classification Search
CPC ..... G07F 17/326; G07F 17/329
USPC ..... 463/17, 18, 20, 25
See application file for complete search history.

(56) References Cited

U.S. PATENT DOCUMENTS

| | | | | |
|---|---|---|---|---|
| 8,651,935 | B2 * | 2/2014 | Caro | G07C 15/005 463/17 |
| 2006/0160602 | A1 * | 7/2006 | Blythe et al. | 463/17 |
| 2009/0186680 | A1 * | 7/2009 | Napolitano | G07F 17/32 463/17 |
| 2010/0025491 | A1 * | 2/2010 | Finocchio | 239/139 |
| 2010/0062826 | A1 * | 3/2010 | Walker et al. | 463/17 |
| 2010/0105462 | A1 * | 4/2010 | Walker et al. | 463/17 |
| 2010/0181755 | A1 * | 7/2010 | Irwin et al. | 283/100 |

* cited by examiner

*Primary Examiner* — Jason Skaarup
(74) *Attorney, Agent, or Firm* — Pearne & Gordon LLP

(57) ABSTRACT

A system and method are described for generating hybrid lottery tickets. The hybrid lottery tickets comprise both an instant win portion and a draw portion. The instant win portion provides the opportunity to win a prize at the time of purchase while the draw portion provides the opportunity to win a prize based on a subsequently occurring draw. The instant win portion is generated based on the draw portion, allowing the hybrid lottery ticket to be generated at the time of purchase.

14 Claims, 10 Drawing Sheets

SYSTEM AND METHOD OF GENERATING HYBRID LOTTERY TICKETS

TECHNICAL FIELD

This application relates generally to generating lottery tickets, and in particular to generating hybrid lottery tickets comprising an instant win portion and a draw portion.

BACKGROUND

Lottery games of both the 'instant win' and 'draw' type games are popular. Instant win tickets typically comprise a number of symbols arranged on a play area of the ticket. The play area is covered with a scratch-off material to hide the symbols prior to scratching-off the material. Once the instant win ticket is purchased, the play area is uncovered by scratching-off the covering material to reveal the symbols and determine if the ticket is a winner.

The draw type lottery ticket typically comprises a plurality of numbers selected by the ticket purchaser or generated randomly by the ticketing system. The ticket is associated with a future draw, in which winning numbers are selected or generated randomly. Numbers from the purchased ticket are matched with the winning numbers of the draw to determine if the ticket is a winner.

Lottery tickets that combine an instant-win ticket with a future draw have been contemplated. Such tickets are similar to regular instant win tickets with a covered game play area, however one of the possible prizes associated with the instant win ticket is a ticket or entry into a future draw type lottery. Such combined tickets require the separation of the instant win portion and the future draw portion. That is although the ticket may combine the two types of games, they are in fact separate games. This is necessary since the instant win tickets are printed in advance of their sale and as such it is not possible to know when one of the tickets will be sold. Since the date at which the instant win ticket will be sold is not known, it is not possible to combine the instant win ticket with the draw portion at the time of printing. Rather if the instant win ticket wins a draw ticket, a separate future draw ticket is issued.

It is desirable to have a hybrid ticket comprising a combined future draw portion and associated instant win portion.

SUMMARY

In accordance with the present disclosure there is provided a method for generating a hybrid lottery ticket comprising retrieving random draw information associated with a future lottery draw, the draw information used in determining if the hybrid lottery ticket is a winner in the future lottery draw; and generating instant win information from the draw information, the instant win information including an indication of whether the draw information is associated with an instant win prize.

In accordance with the present disclosure there is further provided a system for generating a hybrid lottery ticket comprising a processor for executing instructions; and a memory storing instructions for execution by the processor. When the instructions are executed by the processor they configure the system to provide a first component to retrieve random draw information associated with a future lottery draw, the draw information used in determining if the hybrid lottery ticket is a winner in the future lottery draw; and a second component to generate instant win information from the draw information, the instant win information including an indication of whether the draw information is associated with an instant win prize.

BRIEF DESCRIPTION OF THE DRAWINGS

Embodiments are described herein with references to the appended drawings, in which.

DETAILED DESCRIPTION

A hybrid lottery ticket as described further herein comprises a future draw portion and an instant win portion. In contrast to previous hybrid tickets, which required generating a separate ticket for entry into a future draw when the instant win portion prize was a ticket for the future draw, the hybrid lottery tickets described herein are generating at the time of purchase and comprise both the instant win portion and the future draw portion. As such, it is not necessary to receive a further ticket for the future draw.

Figure 1:
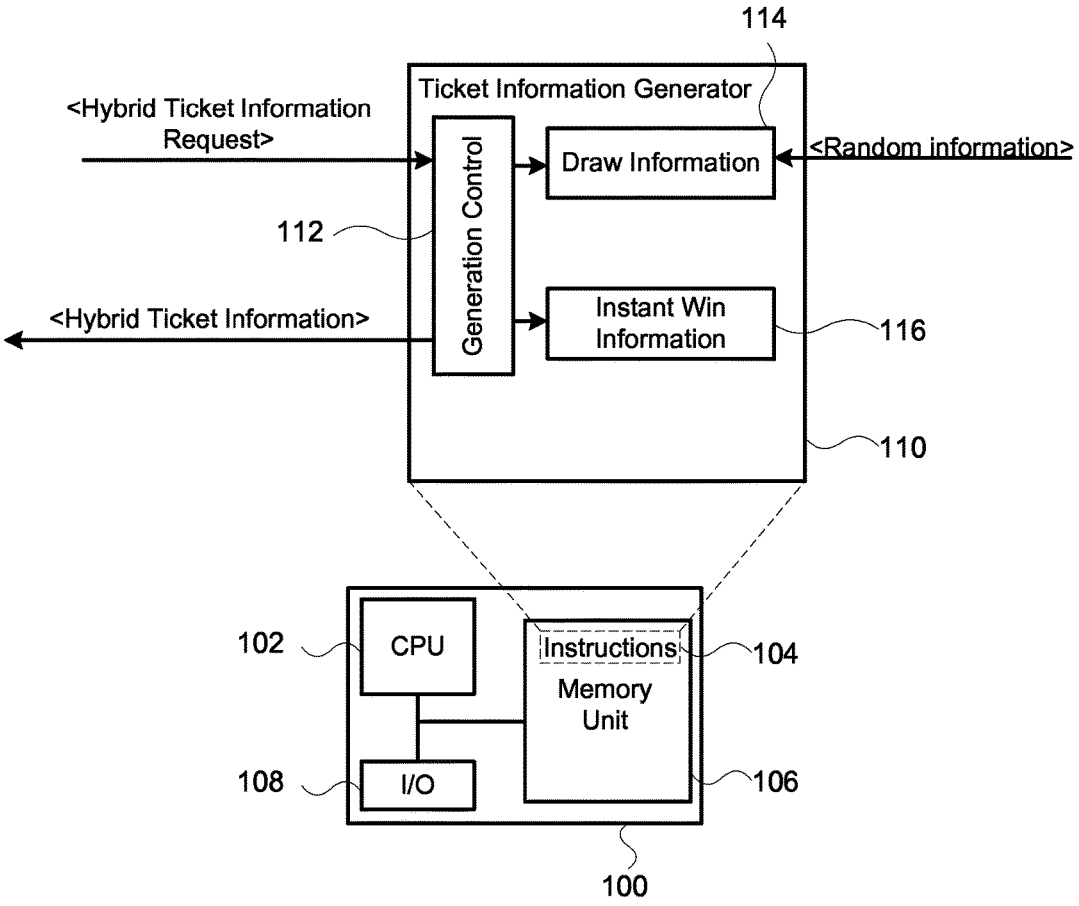
FIG. 1 depicts in a block diagram components of an illustrative system for generating hybrid lottery ticket information.

FIG. 1 depicts in a block diagram components of an illustrative system for generating hybrid lottery ticket information. The hybrid ticket information is used to generate hybrid lottery tickets as described further herein. The system 100 may comprise a processing unit depicted schematically as central processing unit 102 that executes instructions 104 stored in a memory unit 106. The system 100 may also comprise an input/output component 108 for receiving information from other components and/or systems as well as providing information to other components and/or systems.

When the instructions are executed by CPU 102 they configure the system 100 to provide a ticket information generator 110. The ticket information generator 110 comprises a generation control component 112 that receives a hybrid ticket request and returns hybrid ticket information in response. The ticket information generator 110 comprises a draw information component 114 that generates draw information for a future draw portion of the hybrid ticket. The draw information component 114 generates the draw information from random information such as a random number or numbers.

The ticket information generator 110 further comprises an instant-win information component 116 that generates the instant-win information. The instant-win information is generated using the draw information from the draw information component 114.

When a request for a hybrid ticket is received at the ticket information generator 110. the generation control 112 requests and receives draw information from the draw information component 114. The draw information is passed to the instant win information component 116 which provides the instant-win information associated with the draw information to the generation control component 112. The generation control component 112 generates and returns the hybrid ticket information which comprises both the future draw information and the instant-win information.

Figure 2:
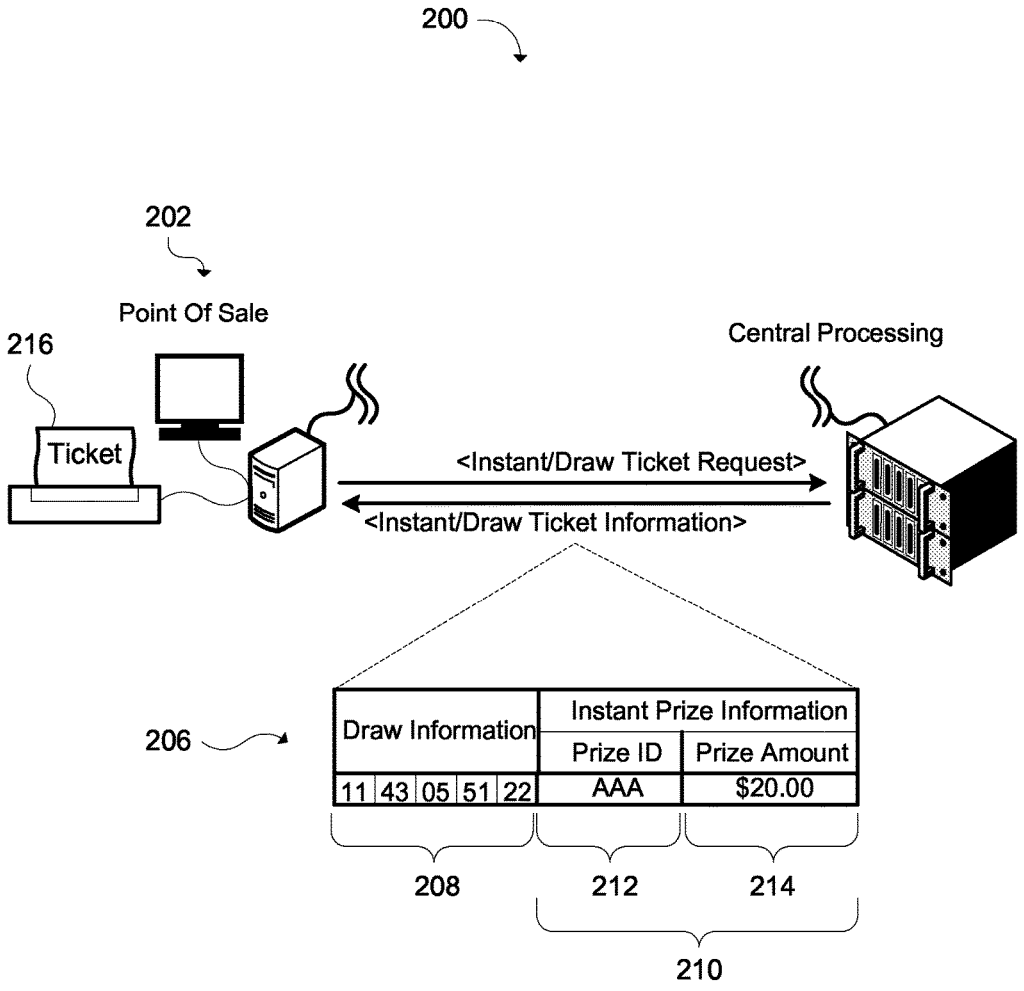
FIG. 2 depicts in a block diagram components of an illustrative system for generating hybrid lottery tickets.

FIG. 2 depicts in a block diagram components of an illustrative system for generating hybrid lottery tickets. The system 200 comprises a point of sale (POS) terminal 202 that receives hybrid ticket requests and generates the hybrid tickets. The POS terminal 202 is coupled to a central processing system 204. The coupling may be over one or more networks, such as the internet. The POS terminal 202 sends a request for hybrid ticket information to the central processing 204, which generates and returns the hybrid ticket information to the POS terminal 202.

The hybrid ticket information 206 comprises draw information 208 and instant win information 210. The draw information 208 may comprise one or more random numbers that are used to match to corresponding winning numbers in a draw. Although depicted as random numbers, the draw information 208 may comprise other information such as letters, symbols, cards etc. The instant win information 210 indicates an instant win prize associated with the draw information 208. As depicted, the instant win information 210 may comprise a prize identifier (ID) 212 as well as an indication of the prize amount (214).

As described further herein, when the POS terminal receives the hybrid ticket information 206, the instant win information is presented to the user using audio and/or video. By presenting the instant win information using audio and/or video the purchaser of the hybrid ticket can be ensured that the printed hybrid ticket received from the POS corresponds to the actual hybrid ticket information, preventing a an instant winner ticket from being switched with a non-winning ticket.

The hybrid ticket is printed and includes a representation of the hybrid ticket information, including both the draw information associated with a draw taking place in the future and the instant win information, which can be redeemed immediately, assuming that the instant win prize is a monetary amount that can be redeemed at the POS.

At a later time or date, winning draw information is generated, for example by drawing labeled balls, or cards. The printed hybrid ticket that includes the draw information can be checked to determine if the draw information of the hybrid ticket is associated with a winning prize based on the drawn winning information. If the hybrid ticket is associated with a prize, the hybrid ticket may be redeemed to collect the prize.

Figure 3:
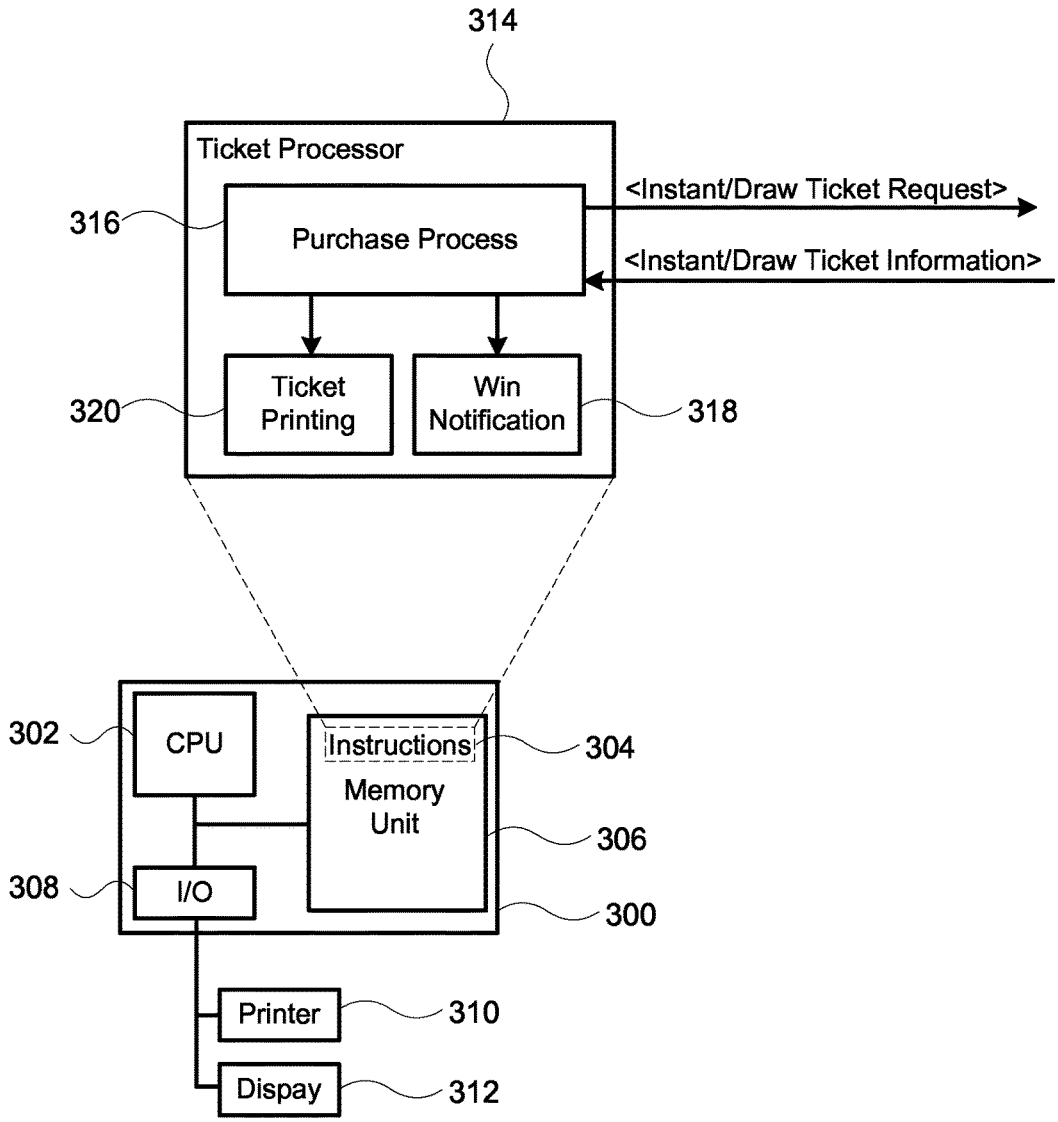
FIG. 3 depicts in a block diagram components of a system for processing purchases of hybrid lottery tickets.

FIG. 3 depicts in a block diagram components of a system for processing purchases of hybrid lottery tickets. The system 300 may be used as the POS terminal 202 described above with reference to FIG. 2. The system 300 may comprise a processing unit depicted schematically as central processing unit 302 that executes instructions 304 stored in a memory unit 306. The system 300 may also comprise an input/output (I/O) component 308 for receiving information from other components and/or systems as well as providing information to other components and/or systems. As depicted the I/O component 308 can be connected to a printer 310 for printing the hybrid tickets as well as a display 312 for presenting the instant win information upon purchase.

When the instructions are executed by CPU 302 they configure the system 300 to provide a ticket processor 314. The ticket processor 314 comprises a purchase process 316 for receiving a request for a hybrid ticket. The upon receiving a hybrid ticket purchase request, the purchase process 316 may provide a prompt to ensure that payment is collected prior to proceeding. This prompting may be done in order to avoid a purchaser refusing payment if the instant win portion of the hybrid ticket was not a winner. Once payment confirmation is received, the purchase process requests, and receives in response, hybrid ticket information. The hybrid ticket information comprises both draw information and associated instant win information. Upon receiving the hybrid ticket information the purchase process 316 passes the instant win information to a instant win notification component 318 which displays a representation of the instant win information on the display 312, including an indication of if the instant win information is associated with a prize.

The purchase process 316 also provides the hybrid ticket information to a ticket printing component 320 that generates a representation of the hybrid ticket information and prints the hybrid ticket, including both the draw information and the instant win information. The printing component 320 may also include the time at which the hybrid ticket was printed in order to provide a means of ensuring that the purchased hybrid ticket is in fact the ticket received by the purchaser.

Figure 4:
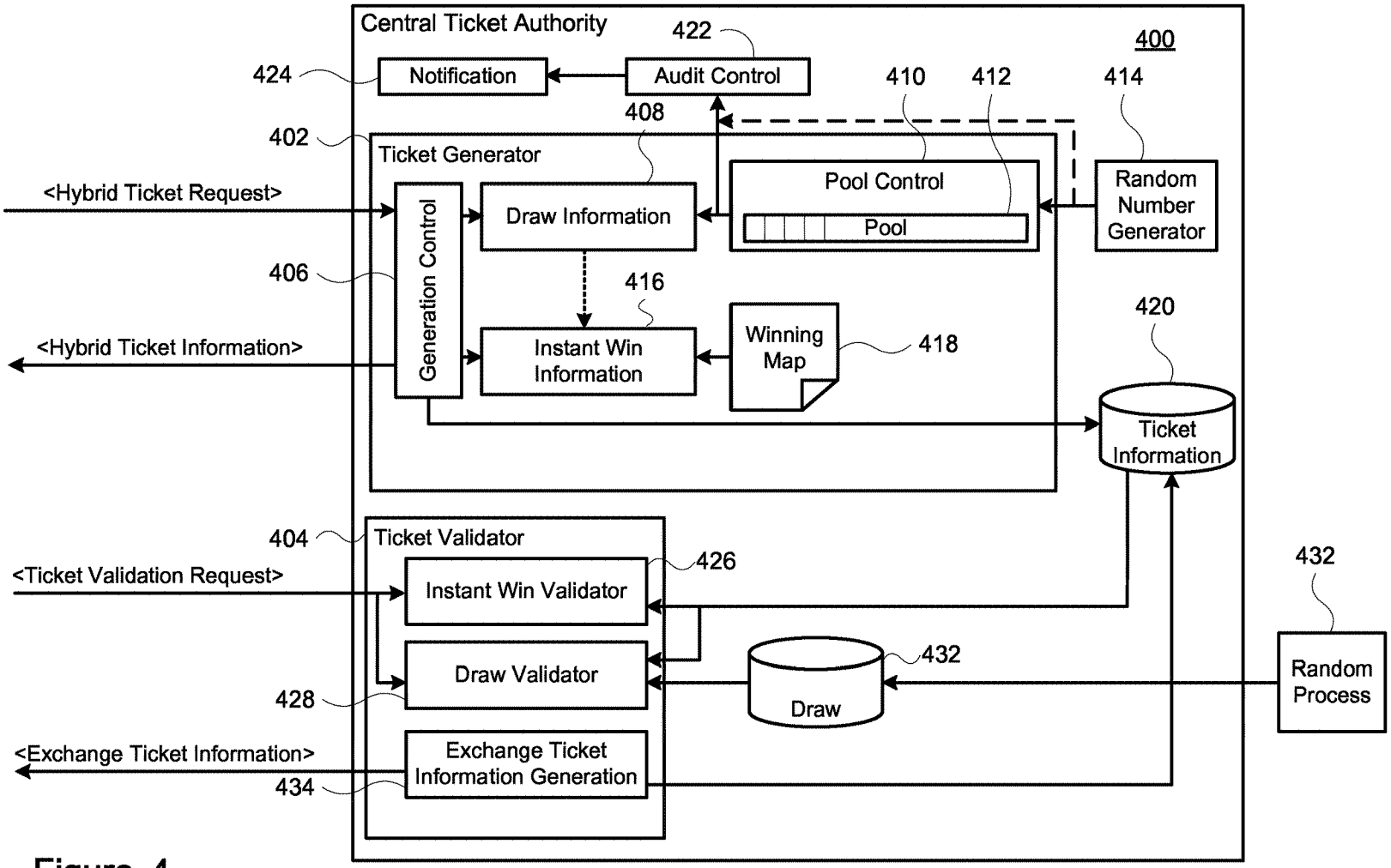
FIG. 4 depicts in a block diagram components for generating and validating hybrid lottery ticket information.

FIG. 4 depicts in a block diagram components for generating and validating hybrid lottery ticket information at a central ticket authority. The central ticket authority 400 may communicate with a plurality of POS terminals. As described further, the central ticket authority generates and validates hybrid ticket information. The central ticket authority 400 may also generate and/or validate ticket information for other lottery games. The central ticket authority 400 may comprises a hybrid ticket generator 402 for generating hybrid ticket information. The central ticket authority 400 may also comprise a ticket validator 404 which validates ticket information for redeeming a purchased ticket for a prize.

The ticket generator 404 may be similar in functionality to the ticket generator 110 described above with reference to FIG. 1. The ticket generator 402 comprises a generation control component 406. The generation control component 406 receives a request for hybrid ticket information, generates and returns the hybrid ticket information. The generation control component 406 requests draw information from a draw information component 408. The draw information may be a random number or a plurality of random numbers. Additionally or alternatively, the draw information may comprise random letters, symbols, cards or other information that can be used to match with corresponding information generated during the draw associated with the future draw portion of the hybrid ticket. For simplicity and clarity, the draw information is described as a single random number; however, one skilled in the art would readily understand how to extend the teachings to apply to various different draw information.

As described above, the generation control component 406 requests draw information from the draw information component 408. The draw information component 408 retrieves a random number from a pool control component 410. The pool control component 410 comprises a pool 412 of random numbers. The pool control component 410 allows a plurality of random numbers to be generated at a time rather than generating a random number each time a request for draw information is received. The pool control component 410 receives a request for a random number from the draw information component 408, then retrieves and removes a random number from the pool 412. The random number is provided to the draw information component 408. The draw information component 408 may process the random number to generate the draw information. For example, the draw information component 408 could map a random number to one of a plurality of hands of playing cards. The pool control component 410 may monitor the pool 412 of random numbers and if the number of random numbers falls below a threshold, the pool control component 410 fills the pool again using a random number generator 414. The random number generator 414 may generate a plurality of random numbers from within a defined range.

The draw information is returned to the generation control component 406 which uses the draw information to determine instant win information. The generation control component 406 may provide the draw information to an instant win information component 416. The instant win information component 416 uses the draw information to generate associated instant win information. The instant win information may be generated using a winning map 418, which maps the draw information to the instant win information. Since the draw information is determined from a random number generated from a finite range, the winning mapping 418 may be created that maps draw information to instant win information. The instant win information component 416 returns the instant win information associated with the draw information to the generation control component 406.

The generation control component 406 generates the hybrid ticket information which includes both the draw information and the instant win information. The hybrid ticket information is returned to the requesting POS terminal. The generation control component may also store the hybrid ticket information in a ticket information database 420. The ticket information database 420 may store the hybrid ticket information as well as additional details associated with the hybrid ticket purchase, including for example the date and time the ticket was purchased, the store location the hybrid ticket was purchased and any other information that may be required or useful for operating the central ticket authority 400.

The central ticket authority 400 may also comprise an audit control component 422. The audit control component 422 may monitor the random numbers used for the draw information to ensure that the distribution of numbers is acceptable. The audit control component 422 may monitor the random numbers as they are provided to the draw information component 408, or alternatively may monitor the random numbers as they are provided to the pool control 410. Regardless of when the random numbers are monitored, the audit control component can determine if the random number distribution is not within the expected distribution. For example, the audit control component 422 can monitor to determine if a particular random number is used for draw information more than would be expected from a random distribution.

The audit control component 422 may monitor the random numbers on varying levels of granularity. For example, the overall distribution of the random numbers in the pool may be monitored to ensure that the random numbers are in fact being generated in randomly. Additionally or alternatively, the audit control component 422 may also monitor the random numbers used for the draw information of hybrid tickets purchased in a particular geographic location, a group of stores or a particular store. If the audit control component 422 determines that the distribution does not follow the expected distribution for random numbers, an action may be taken by a notification component 422. For example, the notification component 422 may send an email or text message to one or more identified relevant people. The notification component 422 may utilize different levels of actions depending on how sever the discrepancy between the actual and expected distribution is. For example, if it is expected that the same random number can be generated twice per 1000 random numbers, but the same random number has in fact been generated 4 times in the previous 1000 random numbers an notification may be sent to a supervisor to notify them of a possible problem. If it is determined that the same random number has been generated 6 times in the previous 1000 numbers, which is a significantly aberrant behaviour, the notification component 422 may suspend all POS terminal operations, effectively shutting down sale of the hybrid tickets, until it can be determined that the system is operating properly, or the problem is located and corrected.

The central ticket authority 400 includes the ticket validator 404. The ticket validator 404 receives ticket information to be validated. The validation is done when attempting to redeem a ticket for a prize, or determine if the ticket is associated with a prize. As depicted the ticket validator 404 comprises an instant win validator 426 and a draw validator 428. The instant win validator 426 receives validation information that the instant win validator 426 can use to retrieve the instant win information from the ticket information database 420. The validation information may comprise a unique ticket identifier that is associated with the hybrid ticket information, allowing the ticket identifier to be used to retrieve the hybrid ticket information, including the instant win information. The instant win information indicating the prize associated with the ticket being validated may be provided to the POS terminal in response. Once the prize has been redeemed the system may store this information to prevent a winning ticket from being redeemed multiple times.

The draw validator 428 is similar in functionality to the instant win validator 426; however, rather than retrieving whether the ticket is associated with an instant win prize, the draw validator 428 retrieves the draw information associated with the ticket being validated from the ticket information database 420. The draw validator 428 compares the draw information to winning draw information stored in a draw database 430. As is appreciated the draw information is generated at the time of the draw by some random process 432, such as drawing of labeled balls, or cards. The winning draw information resulting from the random process 432 is stored in the draw database 430 to allow draw information from previous draws to be validated. The draw validator 428 compares the retrieved draw information with the winning draw information for the corresponding draw and determines if the draw information is associated with a prize, as well as what prize it is. The prize information may then be returned to the POS terminal validating the ticket.

The ticket validator 404 may also comprise an exchange ticket information generator 434. Since the hybrid ticket comprises an instant win portion as well as a future draw portion, it may be desirable to provide an exchange ticket when redeeming an instant win prize. The exchange ticket information generator creates the information used for printing the exchange ticket. The exchange ticket comprises the same draw information and typically also comprises an indication that it is an exchange ticket and so does not include an instant win portion. The generated exchange information may be returned to a POS terminal and the exchange ticket provided.

Figure 5:
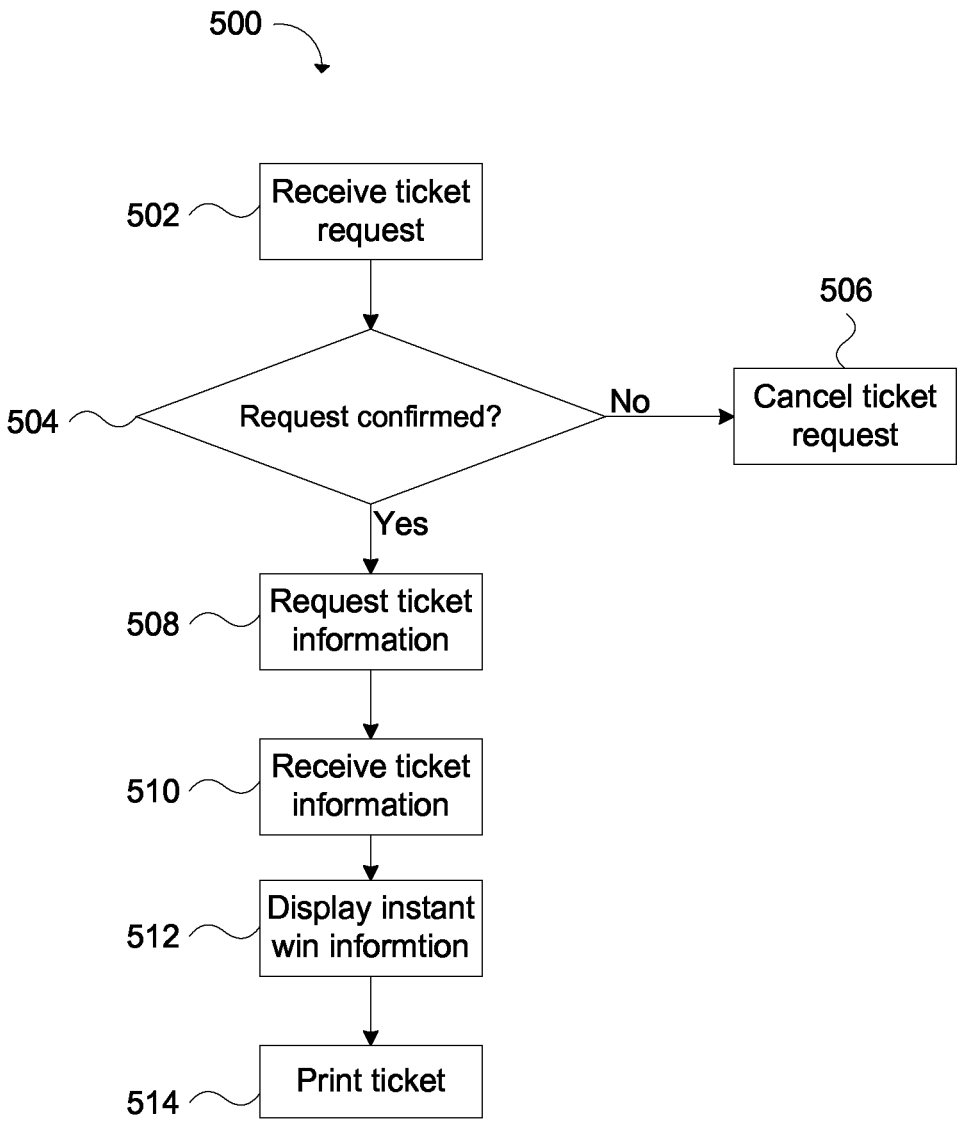
FIG. 5 depicts in a flow chart a method generating a hybrid lottery ticket.

FIG. 5 depicts in a flow chart a method generating a hybrid lottery ticket. The method 500 may be implemented at a POS terminal, such as POS terminal 202 described above with reference to FIG. 2. The method 500 begins with receiving a request for a hybrid lottery ticket (502). The method then determines if the request for the hybrid lottery ticket has been confirmed (504). This may be done by providing an indication on the POS terminal to confirm the purchase and to obtain payment. If confirmation is not received (No at 504), for example if the purchaser does not wish to purchase the hybrid lottery ticket or payment was not received, the hybrid ticket request is cancelled (506). If however confirmation is received (Yes at 508) hybrid ticket information is requested (508) and received (510). As described above, the hybrid ticket information comprises both instant win information and draw information. The instant win information, or a representation of the instant win information, is displayed (512), which may comprise for example playing a piece of audio and/or video indicating if the instant win portion is associated with a prize. The hybrid ticket is also printed (514) and provided to the purchaser.

Figure 6:
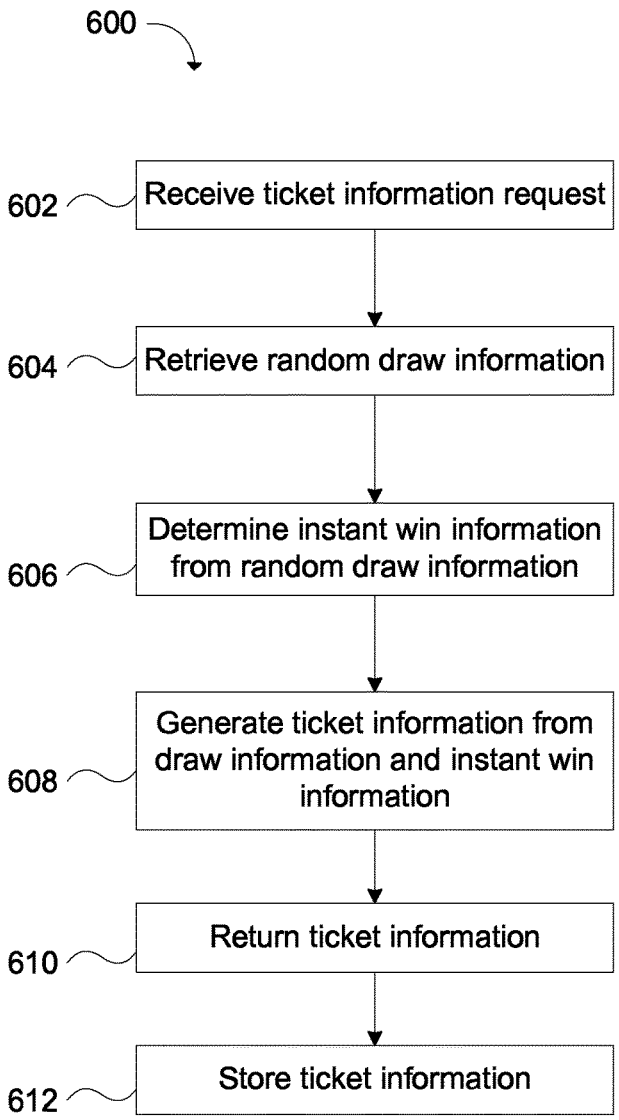
FIG. 6 depicts in a flow chart a method of generating hybrid lottery ticket information.

FIG. 6 depicts in a flow chart a method of generating hybrid lottery ticket information. The method 600 begins with receiving a request for hybrid ticket information (602). Draw information is retrieved or generated (604). As described above, the draw information may be one or more random numbers or similar letters, symbols, cards etc. The draw information may be retrieved directly or a random number or numbers may be retrieved and the draw information generated based on the random number or numbers. Instant win information associated with the draw information is determined (606). The instant win information may be generated by using a predetermined mapping that maps the draw information to instant win prize information. For example the mapping may indicate that the random number 1554 is associated with an instant win prize of $20.00. Once the instant win information is determined hybrid ticket information is generated to include both the draw information and the instant win information (608). The generated ticket information is returned to the requester (610) and stored (612), for example in a ticket information database. The hybrid ticket information may also comprise a unique ticket identifier, which may be used to retrieve the instant win information and/or the draw information associated with the purchased ticket when validating and/or redeeming a hybrid ticket.

Figure 7:
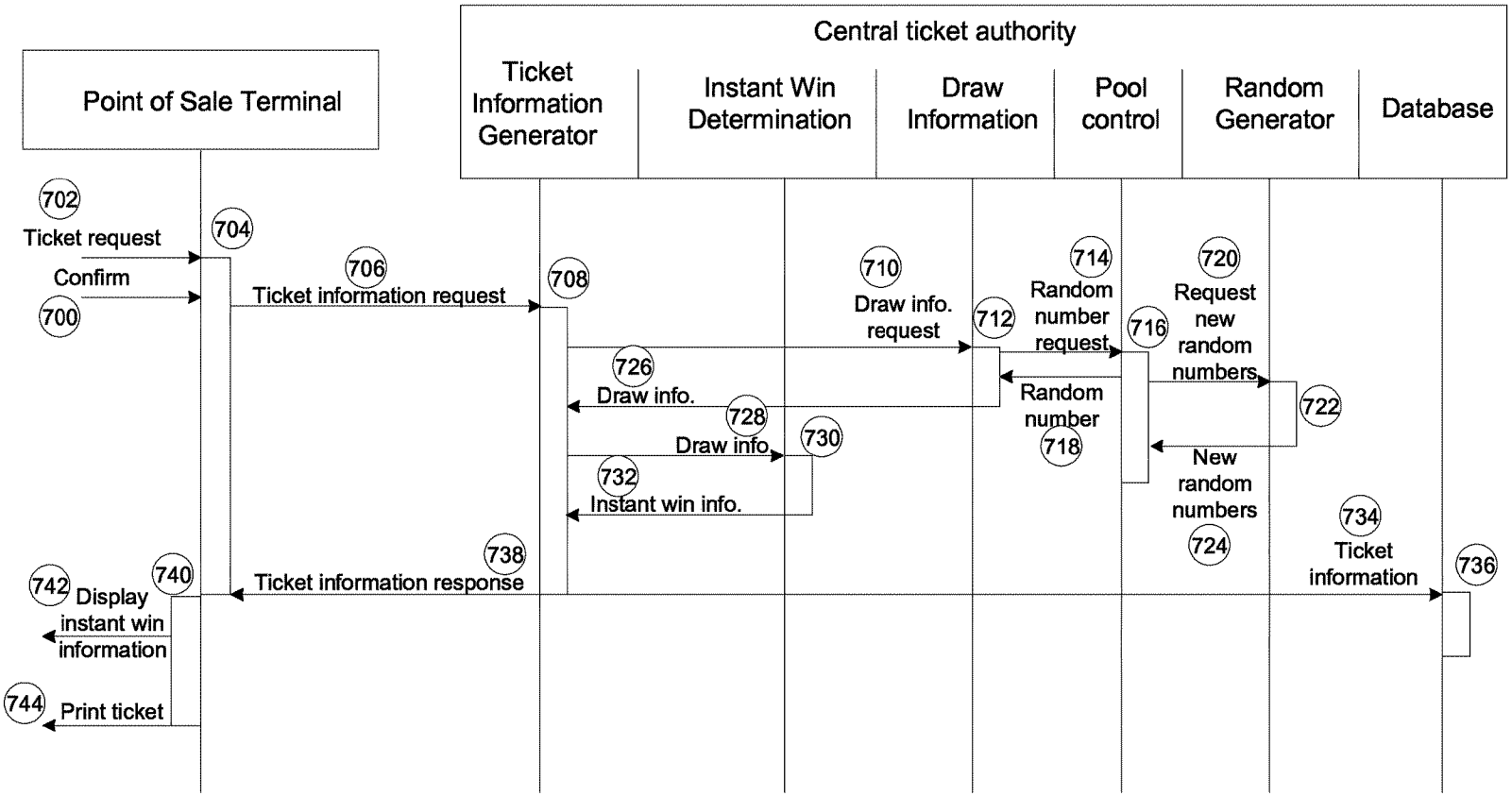
FIG. 7 depicts in a process flow diagram a process of generating a hybrid lottery ticket.

FIG. 7 depicts in a process flow diagram a process of generating a hybrid lottery ticket. As depicted in FIG. 7, a POS terminal communicates with a central ticket authority that provides hybrid ticket information. The process begins when a hybrid ticket is requested (702) at the POS terminal. The POS terminal begins the purchase process (704). Once confirmation of the purchase is received (706) a hybrid ticket information request is sent to the central ticket authority (706). The ticket information generator of the central ticket authority receives the request and begins generating the hybrid ticket information (708). Draw information is request (710) from the draw information component. The draw information component receives the request and generates the draw information (712), which includes requesting a random number or numbers (714) from the pool control component. The pool control component receives the request and processes the request (716), which includes removing a random number from the pool and returning it to the draw information component (718). The pool control also determines if the number of random numbers remaining in the pool is below a threshold, and if it is requests additional random numbers (720) from a random number generator. The random number generator generates new random numbers (722) and returns them to the pool control (724) that adds the new random numbers to the pool.

After generating the draw information, the draw information component returns the draw information to the ticket information generator (726), which passes the draw information to the instant win information component (728). The instant win information component generates the instant win information (730) and returns it to the ticket information generator (732). The ticket information generator generates the hybrid ticket information and provides it to a database (734) where it is stored (736). The ticket information generator also returns the ticket information to the POS terminal (738). The POS terminal receives the ticket information (740) and displays the instant win information (742), for example on a display and prints out the hybrid ticket (744).

The process described above with reference to FIG. 7 generates the hybrid ticket information at a central ticket authority. It is contemplated that the hybrid ticket information could also be generated at the POS terminal. The process could be substantially similar to the process of FIG. 7; however, the ticket information generator and/or the instant win information component would be located at the POS terminal.

Various systems and methods have been described above for providing a hybrid lottery ticket that comprises a draw portion and an instant win portion determined based on the draw information. One possible embodiment of a hybrid lottery ticket that can be generated such systems and methods is described below with reference to FIGS. 8-13. As depicted the hybrid lottery game is based on the poker card game. The draw information comprises 5 randomly selected cards. The instant win information is based on the poker hand of the draw information.

Figure 8:
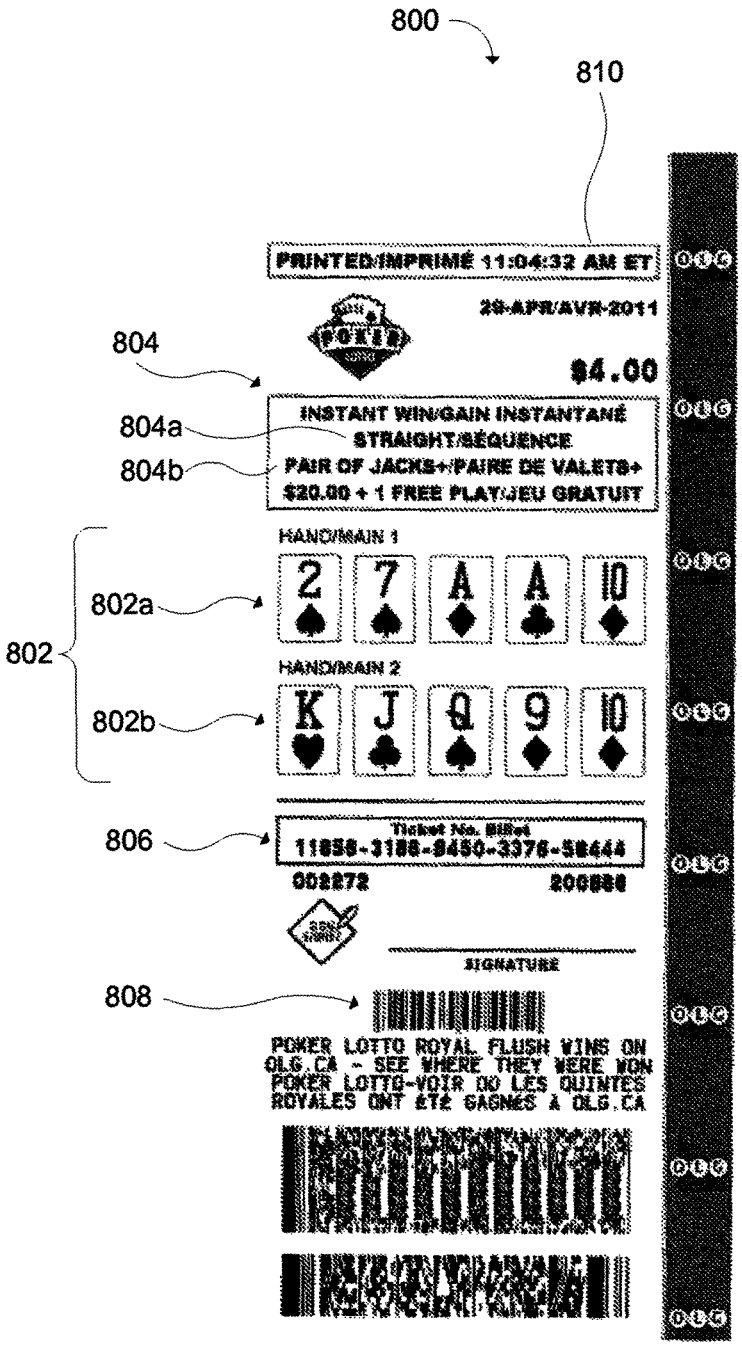
FIG. 8 depicts an illustrative hybrid lottery ticket.
Figure 9:
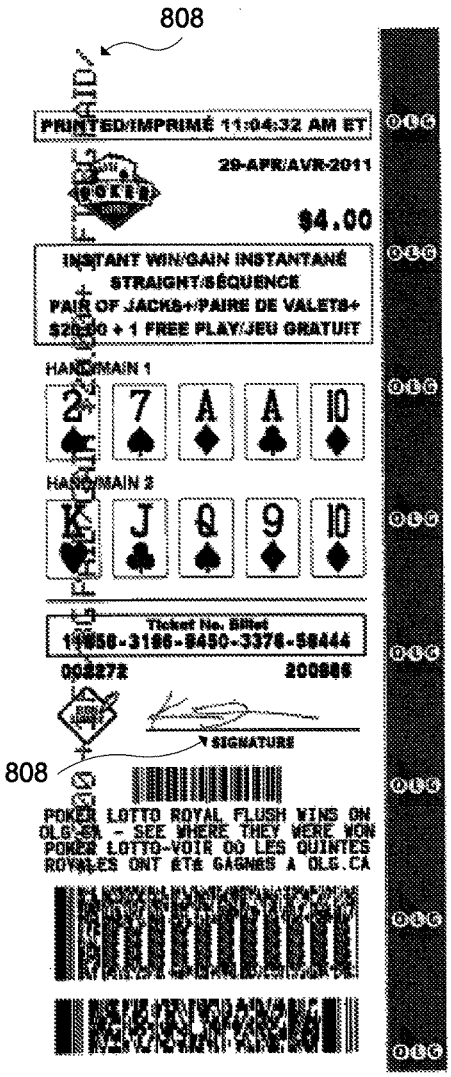
FIG. 9 depicts the hybrid lottery ticket of FIG. 8 after being redeemed.
Figure 10:
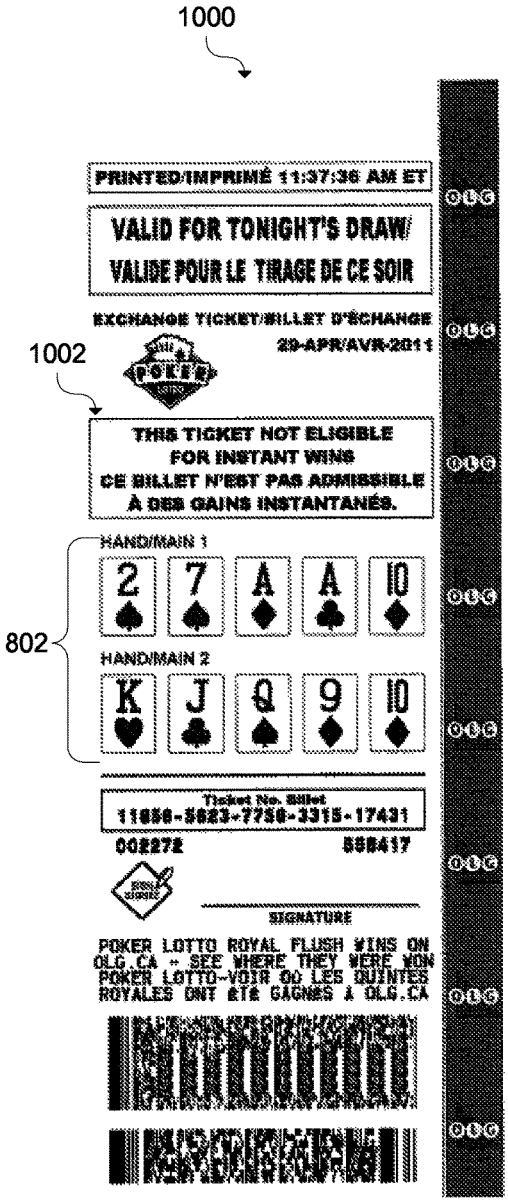
FIG. 10 depicts an exchange ticket for the hybrid lottery ticket of FIG. 8.
Figure 11:
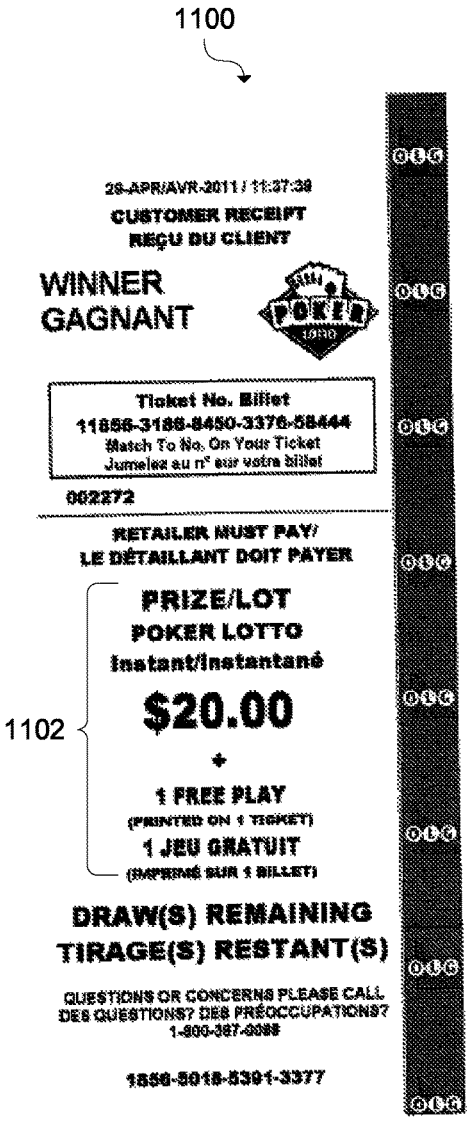
FIG. 11 depicts a receipt ticket associated with the redeemed instant win prizes of the hybrid lottery ticket of FIG. 8.
Figure 12:
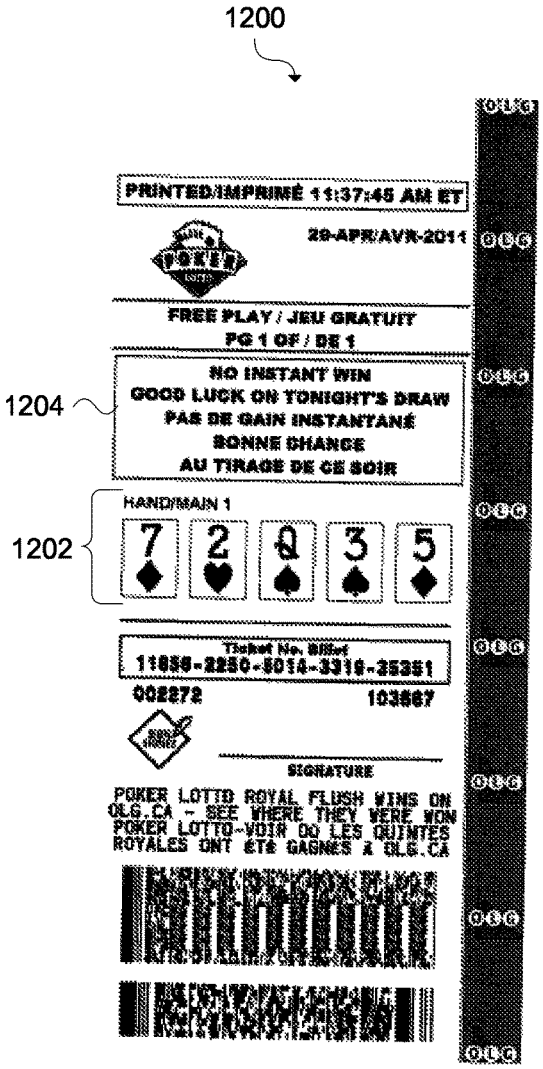
FIG. 12 depicts a further illustrative hybrid lottery ticket.

FIG. 8 depicts a hybrid lottery ticket 800 that is printed in accordance with system and method described above. The hybrid ticket 800 comprises a draw portion 802 and an instant win portion 804. The hybrid ticket also includes a unique ticket identifier 806, which may also be incorporated into a barcode 808. The hybrid ticket also includes the time and date the ticket was printed 810.

The above description has described providing a single draw information; however as depicted a single ticket may be associated with a plurality of 'plays'. One skilled in the art will appreciate that each play can be produced as described above and combined onto a single hybrid ticket. The ticket 800 comprises two 'plays' 802*a*, 802*b*. Each play comprises a poker hand of 5 randomly selected cards. Each of the hands 802*a*, 802*b* offer the purchaser a chance to win a prize by matching a plurality of the cards of the hands 802*a*, 802*b* to the cards randomly selected for the draw.

The ticket 800 also comprises an instant win portion 804. The instant win portion 804 indicates a poker hand as well as an associated prize 804*a*, 804*b* for each of the hands 802*a*, 802*b* of the draw information. As depicted in the instant win portion, one of the hands comprises a pair of 'jacks' and a straight. It is noted that for simplicity the any pairs of Jacks, Queens, Kings or Aces are referred to as a pair of jacks. The prize associated with the pair of jacks is a free hybrid lottery ticket. The prize associated with a straight is $20.00.

When the POS terminal receives the hybrid information, it displays the instant win information. In the case of a poker game, the display may comprise an animation depicting the cards of the draw information being dealt, and an indication of the prize amount associated with the hand, or an indication that the hand is not associated with a prize. If the ticket comprises multiple hands, the animation for each hand can be played sequentially, or the animation can be adjusted to display an animation of both hands being dealt followed by an indication of the instant win information.

Assuming that the hybrid ticket is an instant winner, such as ticket 800, the instant win prize can be redeemed immediately, or alternatively, the instant win prize can be redeemed after the results of the draw. If the hybrid ticket is redeemed immediately, the original ticket is signed 812 and marked 814 to indicate that the prize has been redeemed. An exchange ticket 1000 is provided, that comprises the same draw information 802 as the original ticket but does not include the instant win information. Instead the exchange ticket 1000 comprises an indication that the ticket is an exchange ticket and so is not eligible for instant wins 1002. In addition to the exchange ticket 1000, a receipt ticket 1100 is provided for the instant win prizes. The receipt ticket 1100 indicates the prizes won 1102. In the case depicted, an additional hybrid ticket 1200 is provided in the same manner as if the hybrid ticket was purchased.

The hybrid ticket 1200 comprises a single draw hand 1202. The hand 1202 of the draw information does not correspond to a poker hand and as such, no instant win prize is awarded. The instant win portion 1204 indicates that there is no instant win prize. Although no prize was won instantly, the hybrid ticket may still win a prize in the scheduled future draw if the cards of the hand 1202 match some of the winning cards of the draw. In the hybrid lottery depicted, a draw takes place each day. It is contemplated that the frequency of the draw portion may be varied, for example, weekly or monthly.

The systems and methods described above provide the ability to generate a hybrid lottery ticket comprising draw information and instant win information based on the draw information. The system and methods described herein have been described with reference to various examples. It will be appreciated that components from the various examples may be combined together, or components of the examples removed or modified. As described the system may be implemented in one or more hardware components including a processing unit and a memory unit that are configured to provide the functionality as described herein. Furthermore, a computer readable memory, such as for example electronic memory devices, magnetic memory devices and/or optical memory devices, may store computer readable instructions for configuring one or more hardware components to provide the functionality described herein.

What is claimed is:

1. A method for generating a hybrid lottery ticket comprising a future draw portion and an instant win portion, the method comprising:

receiving a hybrid ticket information request at a computing system from a point of sale (POS) terminal;

retrieving at the computing system random draw information associated with a future lottery draw, the draw information used in determining if the hybrid lottery ticket is a winner in the future lottery draw;

mapping at the computing system the draw information to a poker hand of playing cards;

generating at the computing system instant win information from the poker hand mapped from the draw information, the instant win information including an indication of whether the draw information is associated with an instant win prize;

generating at the computing system hybrid ticket information based on:

the draw information used in determining if the hybrid lottery ticket is a winner in the future lottery draw; and the instant win information providing an indication of whether the hybrid lottery ticket is associated with the instant win prize; and returning the hybrid ticket information to the POS terminal in response to the hybrid ticket information request;

providing a visual and auditory representation of the instant win information at the POS terminal; and printing the hybrid lottery ticket including a playing card representation of the draw information used in determining if the hybrid lottery ticket is a winner in the future lottery draw and a printed representation of the instant win information providing the indication of whether the hybrid lottery ticket is associated with the instant win prize.

2. The method of claim 1, further comprising:

receiving a request for the hybrid lottery ticket at the POS terminal;

confirming payment for the hybrid lottery ticket; and sending the hybrid ticket information request to the computing system once the payment confirmation has been received.

3. The method of claim 1, further comprising:

storing the generated hybrid ticket information and an associated unique identifier in a database coupled to the computing system.

4. The method of claim 1, wherein the draw information comprises at least one random number retrieved from a pool of random numbers, the method further comprising:

removing the at least one random number from the pool after retrieval;

determining if the number of random numbers remaining in the pool is below a threshold; and generating a plurality of new random numbers and storing in the pool when the number of random numbers remaining in the pool is below the threshold.

5. The method of claim 1, wherein the draw information comprises an indication of a plurality of playing cards, and generating instant win information comprises:

determining a hand of a card game associated with the plurality of playing cards; and determining an instant win prize amount based on the determined hand.

6. The method of claim 5, wherein the hybrid lottery ticket comprises a plurality of hands each comprising individually determined ticket information comprising respective draw information and associated instant win information.

7. The method of claim 1, further comprising:

monitoring the retrieved draw information to determine if the same draw information has been retrieved more than a set threshold over a predetermined time period; and sending out a notification as an alert of suspect operation when the same draw information has been retrieved more than the set threshold over the predetermined time period.

8. A system for generating a hybrid lottery ticket comprising: a processor located at a central location for executing instructions; and a memory located at the central location storing instructions for execution by the processor, the instructions when executed by the processor configuring the system to provide:

a first component to retrieve random draw information associated with a future lottery draw, the draw information used in determining if the hybrid lottery ticket is a winner in the future lottery draw;

a second component to map the draw information to a poker hand of playing cards;

a third component to generate instant win information from the poker hand mapped from the draw information, the instant win information including an indication of whether the draw information is associated with an instant win prize; and a fourth component to generate hybrid ticket information based on:

the draw information used in determining if the hybrid lottery ticket is a winner in the future lottery draw; and the instant win information providing an indication of whether the hybrid lottery ticket is associated with the instant win prize;

a fifth component to receive a hybrid ticket information request at the central location, and return the hybrid ticket information in response to the hybrid ticket information request; and a point of sale (POS) terminal for receiving the returned hybrid ticket information, the POS terminal comprising:

a display to provide a visual and auditory representation of the instant win information at the POS terminal; and a printer to print the hybrid lottery ticket including a playing card representation of the draw information used in determining if the hybrid lottery ticket is a winner in the future lottery draw and a printed representation of the instant win information providing the indication of whether the hybrid lottery ticket is associated with the instant win prize.

9. The system of claim 8, wherein the POS terminal is configured to:

receive a request for the hybrid lottery ticket;

confirm payment for the hybrid lottery ticket; and send the hybrid ticket information request to the central location once the payment confirmation has been received.

10. The system of claim 8, further comprising:

a database coupled to the central location to store the generated hybrid ticket information and an associated unique identifier.

11. The system of claim 8, wherein the draw information comprises at least one random number retrieved from a pool of random numbers, the system further comprising:

a further component to remove the at least one random number from the pool after retrieval, determine if the number of random numbers remaining in the pool is below a threshold, and store a plurality of new random numbers in the pool when the number of random numbers remaining in the pool is below the threshold.

12. The system of claim 8, wherein the draw information comprises an indication of a plurality of playing cards, and generating the instant win information comprises:

determining a hand of a card game associated with the plurality of playing cards; and determining an instant win prize amount based on the determined hand.

13. The system of claim 12, wherein the hybrid lottery ticket comprises a plurality of hands each comprising individually determined ticket information comprising respective draw information and associated instant win information.

14. The system of claim 8, further comprising:

a sixth component to monitor the retrieved draw information to determine if the same draw information has been retrieved more than a set threshold over a predetermined time period, and send out a notification as an alert of suspect operation when the same draw information has been retrieved more than the set threshold over the predetermined time period.

* * * * *